US012324472B2

(12) United States Patent
Benoit

(10) Patent No.: US 12,324,472 B2
(45) Date of Patent: Jun. 10, 2025

(54) HELMET WITH HOLDING DEVICE AND FORCE ABSORBER

(71) Applicant: DELTA PLUS GROUP, Apt (FR)

(72) Inventor: Jerome Benoit, Goult (FR)

(73) Assignee: DELTA PLUS GROUP, Apt (FR)

( * ) Notice: Subject to any disclaimer, the term of this patent is extended or adjusted under 35 U.S.C. 154(b) by 7 days.

(21) Appl. No.: 18/412,590

(22) Filed: Jan. 14, 2024

(65) Prior Publication Data

US 2025/0143400 A1 May 8, 2025

(30) Foreign Application Priority Data

Nov. 8, 2023 (FR) ..... 2312133

(51) Int. Cl.
*A42B 3/06* (2006.01)

(52) U.S. Cl.
CPC ..... *A42B 3/062* (2013.01)

(58) Field of Classification Search
CPC ..... A42B 3/062; A42B 3/14; A42B 3/142; A42B 3/145; A42B 3/147; A63B 71/10; F41H 1/04–08
See application file for complete search history.

(56) References Cited

U.S. PATENT DOCUMENTS 2,796,609 A * 6/1957 Fisher ..... A42B 3/14 2/416
3,613,113 A * 10/1971 Alleo ..... A42B 3/10 2/420
3,994,023 A * 11/1976 Aileo ..... A42B 3/14 2/419
4,000,520 A 1/1977 Svendsen et al.
4,051,555 A * 10/1977 Daly ..... A42B 3/14 2/6.6
4,354,283 A * 10/1982 Gooding ..... A42B 3/14 2/413
4,833,735 A 5/1989 Long et al.
5,774,900 A * 7/1998 Wu ..... A42B 3/28 2/416
5,996,126 A * 12/1999 Barthold ..... A42B 3/14 2/416
6,081,931 A * 7/2000 Burns ..... A42B 3/14 2/416
6,817,039 B1 * 11/2004 Grilliot ..... A42B 3/122 2/416

FOREIGN PATENT DOCUMENTS

EP 4039117 A1 8/2022

* cited by examiner

*Primary Examiner* — Katherine M Moran
(74) *Attorney, Agent, or Firm* — Soquel Group LLC

(57) ABSTRACT

A helmet including an outer shell and a holding device which includes a perimeter forming a closed loop, at least two straps attached to the perimeter and/or to the shell and a support cushion. The holding device further includes a force absorber provided with at least three orifices for the passage of at least one strap, each orifice connecting a first and a second face of the force absorber. At least one strap passes successively through a first orifice, a second orifice and a third orifice, extending on the first face between the first orifice and the second orifice and on the second face between the second orifice and the third orifice. The strap is folded 180° around an edge of the second orifice.

15 Claims, 4 Drawing Sheets

A.

B.

HELMET WITH HOLDING DEVICE AND FORCE ABSORBER

CROSS-REFERENCE TO RELATED APPLICATIONS

This application is a U.S. non-provisional application claiming the benefit of French Application No. 23 12133, filed on Nov. 8, 2023, which is incorporated herein by reference in its entirety.

TECHNICAL FIELD OF THE INVENTION

The invention relates to a helmet with a device for holding the shell on the head of a user or dummy used in a test.

BACKGROUND OF THE INVENTION

In the field of safety helmets, used in particular on building sites, it is known to produce a helmet in the form of a rigid shell equipped with a holding device, usually adjustable, which enables the shell to be held around and at a distance from the user's head.

It is known to equip the holding device with a cushion designed to rest on the user's head, in order to limit friction on the upper part of the skull when using the helmet. The function of such a cushion is to improve helmet comfort. A helmet fitted with an elastomer comfort cushion is known from EP4039117A1.

On the other hand, U.S. Pat. No. 4,833,735A discloses a helmet equipped with a comfort cushion above which the straps of a support device are joined by a cord. In the event of an impact on the outer shell of the helmet, which is connected to the holding device, this force is transmitted to the cord in the form of a tensile force. The cord must therefore absorb the forces in the event of an impact, with the risk of the cord breaking.

U.S. Pat. No. 4,000,520A also describes the use of a cushion to distribute forces applied to the outer shell of a helmet.

With this known equipment, in the event of a violent impact on the outer shell of the helmet, it cannot be ruled out that the user's head may strike the inner surface of the shell, as a result of the holding device deforming or breaking. The shock is then transmitted entirely to the user's skull, which can be dangerous for the user.

However, helmets are subject to standards, such as EN397 in Europe and ANSI/ASSE Z359 in the United States.

There is therefore a need to improve existing helmets to meet these standards, in order to guarantee user safety.

SUMMARY OF THE INVENTION

It is this technical problem that the present invention more particularly seeks to remedy by proposing a new helmet that satisfies the above-mentioned standards, while being simple and economical in structure.

To this end, the invention relates to a helmet including an outer shell and a holding device for holding the outer shell on a user's head, this holding device including:

- a perimeter forming a closed loop;
- at least two straps attached to the perimeter and/or to the outer shell;
- a cushion to support the user's head, wherein:

- the holding device includes a force absorber provided with at least three orifices for the passage of at least one strap, each orifice connecting a first face of the force absorber and a second face of the force absorber opposite the first face;
- at least one strap passes successively through a first orifice, a second orifice and a third orifice, extending on the first face between the first orifice and the second orifice and on the second face between the second orifice and the third orifice; and
- the strap is folded 180° around one edge of the second orifice.

Thanks to the invention, the force absorber forms a loop in which the or each strap which passes successively through the first orifice, the second orifice and the third orifice is tied off by surrounding the edge of the second orifice. In the event of an intense force being exerted on this strap as a result of an impact on the outer shell, the strap tends to close around this edge and transmit part of this force to the absorber, which may deform locally to dissipate part of this force. So, in the event of an impact, the impact energy is not, or is only partially, transmitted to the user's head by contact between the inner surface of the shell and the user's head, which is safer for the user.

According to advantageous but not mandatory aspects of the invention, the helmet may incorporate one or more of the following features, used in any combination that is technically feasible:

- The force absorber is made of an elastically deformable material, in particular a thermoplastic elastomer.
- Each orifice is elongated with its largest dimension greater than or equal to the width of each strap passing through it.
- The force absorber is in the shape of a flat plate.
- the force absorber includes five orifices.
- The force absorber includes a central orifice and peripheral orifices, the second orifice preferably being the central orifice.
- The main directions of two adjacent peripheral holes through which the same strap passes form an obtuse angle on the side of the central orifice.
- A longitudinal axis of a strap and a main direction of the second orifice through which this strap passes form an angle greater than or equal to 30°, preferably greater than or equal to 40°, and the longitudinal axis of the strap and a main direction of the first orifice through which this strap passes form an angle greater than or equal to 40°, preferably greater than or equal to 60°.
- The number of holes in the force absorber is equal to twice the number of straps passing through the force absorber plus one.
- Two of the straps are hooked to the perimeter and to the outer shell, and another strap is hooked solely to the outer shell
- The straps hooked to the perimeter pass through the force absorber and the strap hooked solely to the outer shell runs between the cushion and the force absorber.

BRIEF DESCRIPTION OF THE DRAWINGS

The invention will be better understood and advantages beyond this will emerge more clearly in light of the following description of the accomplishment of a helmet using its principle, given solely by way of example and made with reference to the accompanying drawings, in which.

DETAILED DESCRIPTION

Figure 1:
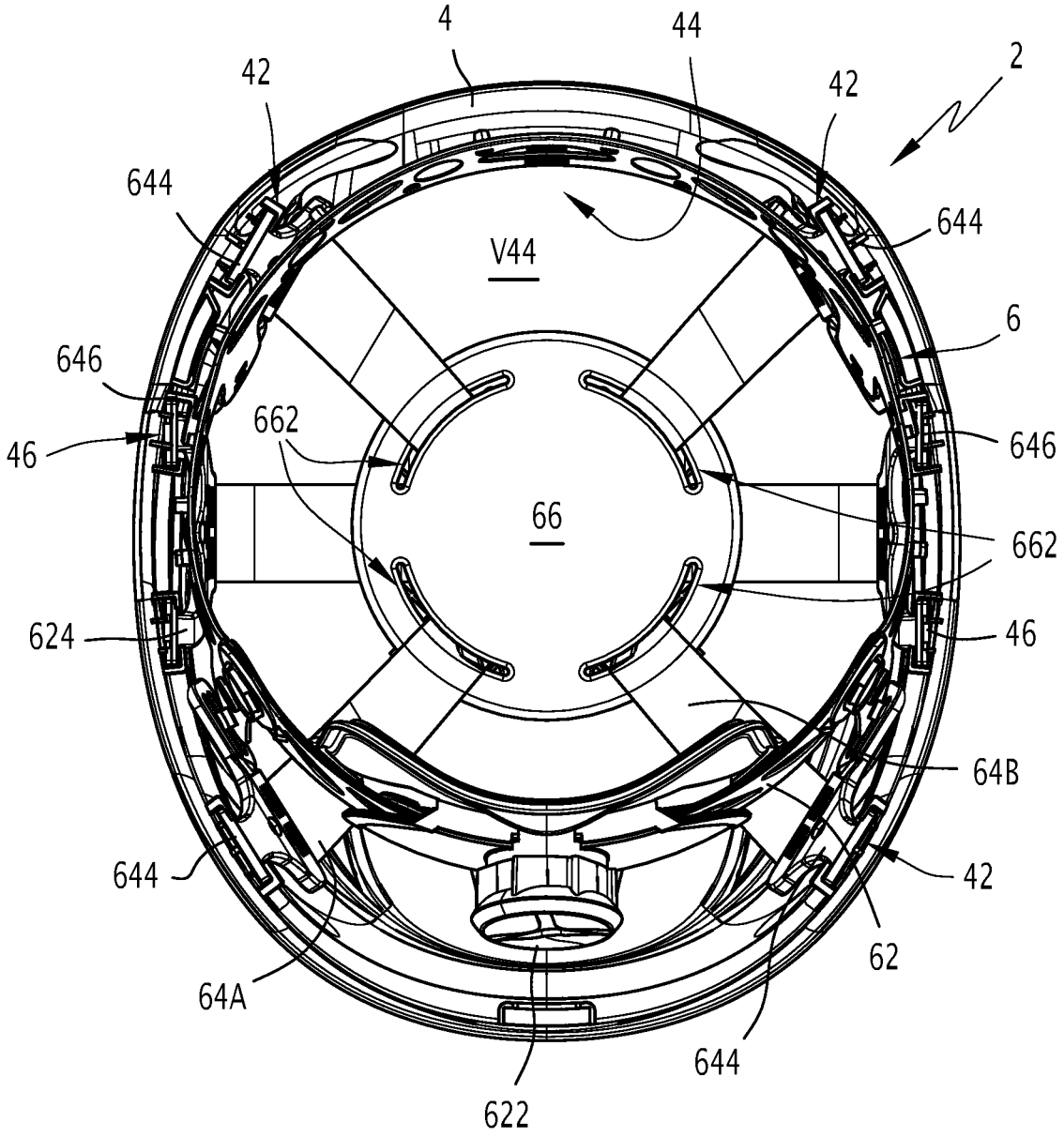
FIG. 1 is a view from below of a helmet in accordance with the invention.

A helmet 2, in accordance with the invention and shown in FIG. 1, includes a rigid outer shell 4 made from a thermoplastic polymer, for example Acrylonitrile butadiene styrene or ABS.

Alternatively, outer shell 4 may be made of another material.

A device 6 for holding helmet 2 on a user's head (not shown) is mounted inside outer shell 4.

Helmet 2 may be mounted on the head of a user who is a human being or on the head of a dummy, in particular when testing the helmet. In what follows, the word "user" covers both the case of a human being and the case of a mannequin.

Holding device 6 includes a perimeter 62, which forms a closed loop, which is intended to be placed around the skull of a user, and which includes a frame of synthetic material, for example of low-density polyethylene, possibly coated with a non-represented trim designed to absorb perspiration and make contact with the user's head more pleasant.

Advantageously, perimeter 62 is equipped with an adjustment system 622 which enables the circumference of perimeter 62 to be adjusted to the size of the user's head.

Holding device 6 also includes three straps 64A, 64B and 64C. There are two types of straps.

The first two straps 64A and 64B are of a first type, and are attached by hooking members 64D to lugs 624 belonging to perimeter 62.

Each hooking member 64D includes at least one slot 642 for receiving a pin 626 integral with one of lugs 624. Preferably, a plurality of slots 642, in this case two slots 642, are provided for each hooking member 64, it being possible for pin 626 to be received, as desired, in one of slots 642, which makes it possible to adjust holding device 6 to the morphology of the user's head. Each hooking member 64D also includes a heel 644 for clipping into a housing 42 provided for this purpose on an inner surface 44 of outer shell 4. Outer shell 4 has four housings 42, each of which accommodates a heel 644.

The first and second straps 64A and 64B suspend holding device 6 in shell 4.

On the other hand, the third strap 64C is of a second type and is provided, at each of its ends, with a member 64E for mounting on outer shell 4. Each mounting member 64E includes two lugs 646 for clipping into housings 46 provided for this purpose on the inner surface 44 of outer shell 4. Outer shell 4 has four housings 46, each of which accommodates a heel 646. The third strap 64C contributes to the suspension function of holding device 6 in the outer shell 4.

On each side of outer shell 4, two adjacent housings 46 are arranged between two housings 42.

Advantageously, straps 64A, 64B and 64C are made by weaving or knitting and are stretchable. For example, the straps may be made of polyamide.

Holding device 6 also includes a cushion 66 designed to rest against the top of the user's skull.

Cushion 66 is made from a material that is pleasant to the touch and generates little friction on the top of the user's skull, for example polyurethane foam.

Cushion 66 is provided with openings 662 for straps 64A and 64B to pass through, enabling cushion 66 to be held in the central part of the inner volume V44 of outer shell 4.

Straps 64A and 64B cross strap 64C on a side of support cushion 66 opposite the user's head, i.e., directed towards inner surface 44.

Figure 2:
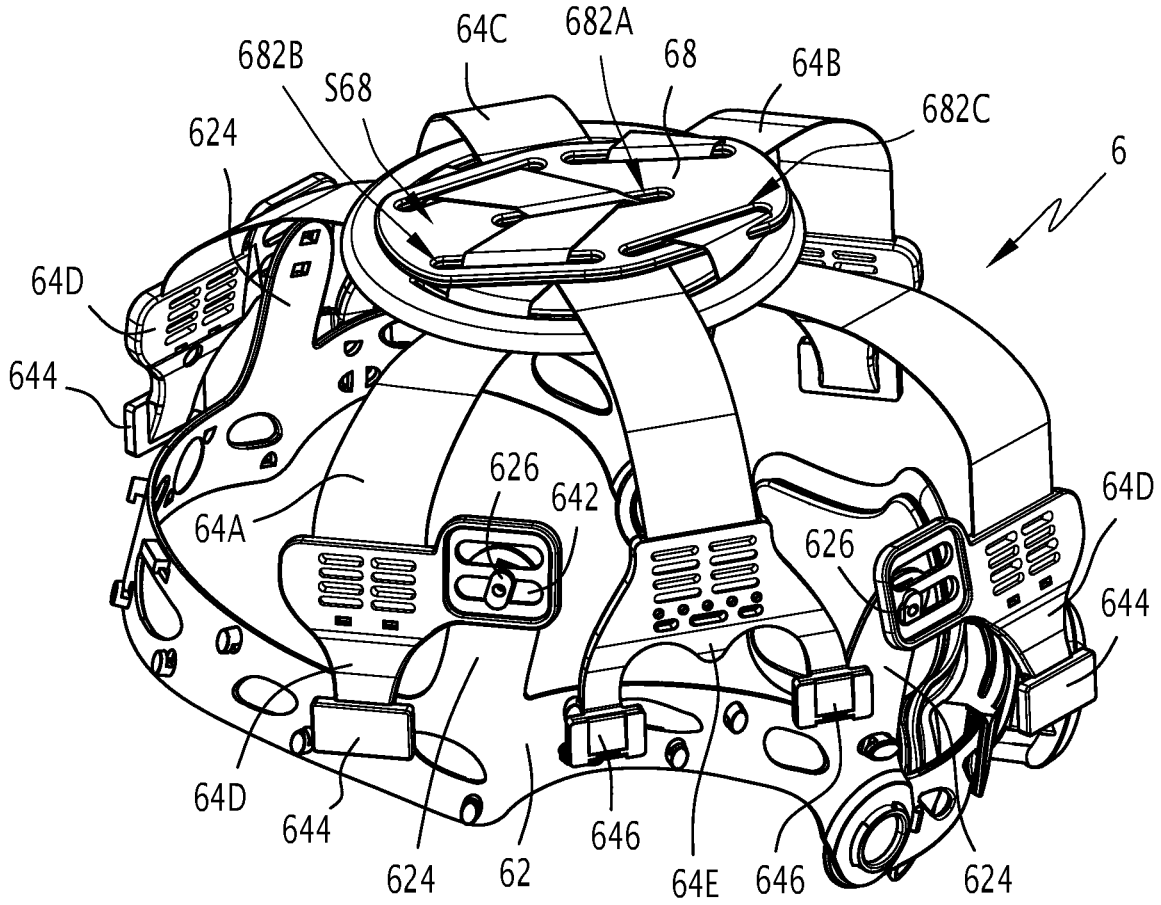
FIG. 2 is a perspective view of a holding device belonging to the helmet of FIG. 1.
Figure 3:
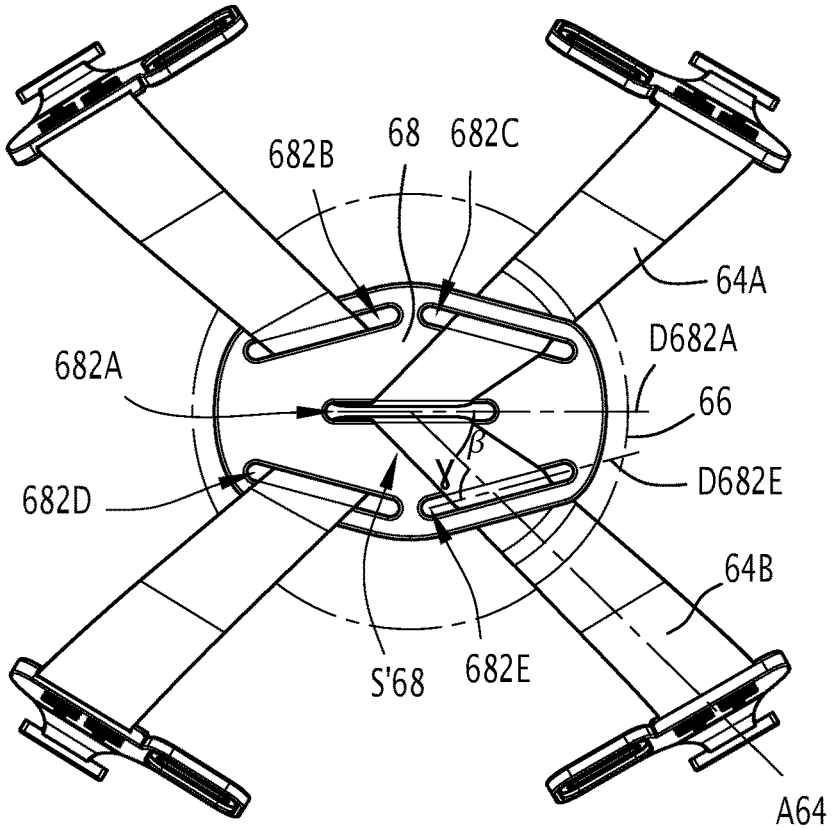
FIG. 3 shows, on two inserts A and B, a possible configuration of the part of the holding device shown in FIG. 2, seen from below and above respectively.
Figure 3:
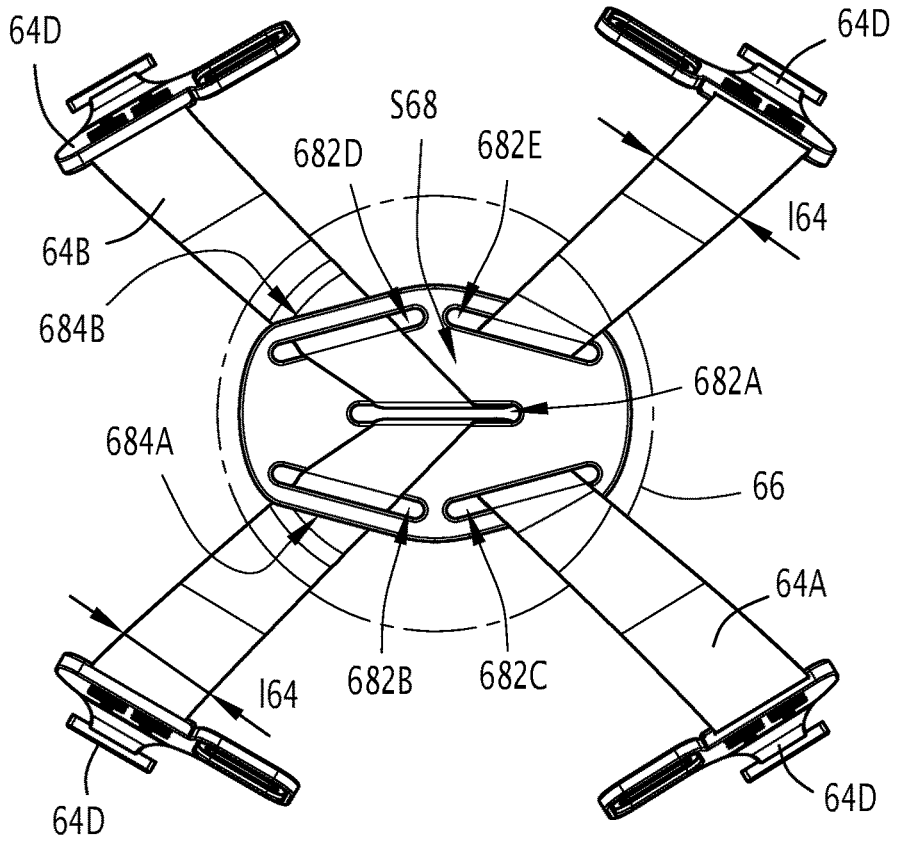

Cushion 66 is not shown in FIGS. 2 and 3, and only its outline is visible in FIG. 3, as a dotted line.

Figure 4:
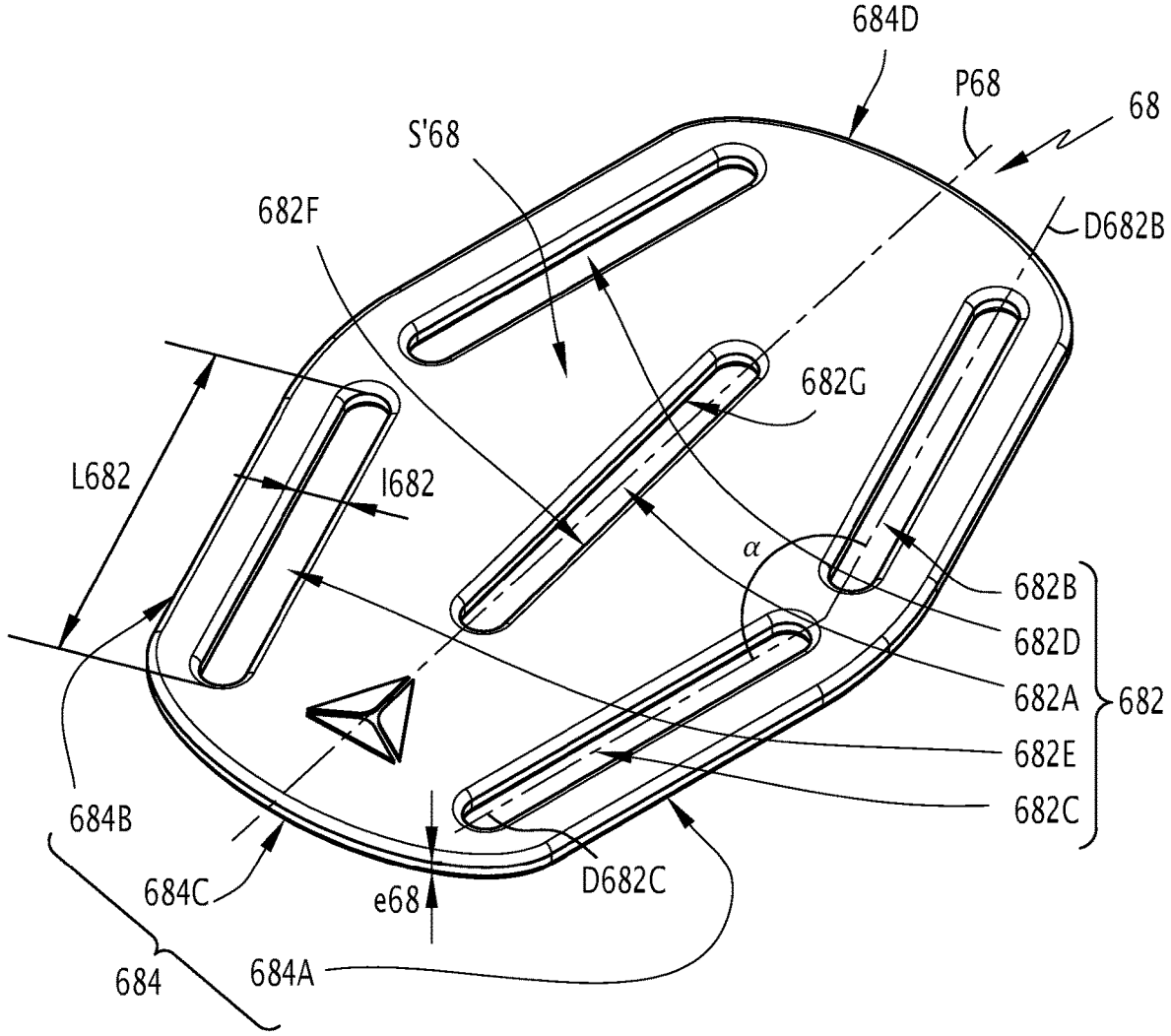
FIG. 4 is a perspective view of a force absorber belonging to the holding device shown in FIGS. 3 and 4.

Holding device 6 also includes a force absorber 68 made in the form of a flat plate with a hexagonal outer shape and which is provided with five orifices 682 passing right through it between an upper face S68 visible in FIG. 2 and on the insert B in FIG. 3, and a lower face S'68 visible on the insert A in FIG. 3 and in FIG. 4. Lower face S'68 is opposite upper face S68.

Force absorber 68 is symmetrical with respect to a plane of symmetry P68 which is perpendicular to faces S68 and S'68.

Apertures 682 include a central orifice 682A and four peripheral orifices 682B, 682C, 682D and 682E which are each disposed close to an edge 684 of force absorber 68. Edge 684 includes two longitudinal edges 684A and 684B and two transverse edges 684C and 684D.

Advantageously, orifices 682 have the same geometry.

Each orifice 682 is elongated and has a length L682 strictly greater than a maximum width 164 of each of the first two straps 64A and 64B.

Each orifice 682 has a width 1682 which is much smaller than its length L682, in particular at least five times smaller than that length, preferably at least ten times smaller than this length.

Advantageously, a main direction of an orifice 682 is parallel to its length L682 and perpendicular to its width 1682.

Advantageously, the main direction D682A of central orifice 682A is contained in plane of symmetry P68.

Note 682F and 682G, two longitudinal edges of central orifice 682A. Advantageously, these edges are parallel to each other. They are preferably parallel to main direction D682A and to plane of symmetry P68.

D682B and D682C are the main directions of peripheral orifices 682B and 682C, respectively. Advantageously, main directions D682B and D682C define an obtuse angle $\alpha$ between them, on the side of central orifice 682A. By way of example, the value of the angle $\alpha$ may be between 60° and 180°.

Given the symmetry of force absorber 68 with respect to plane P68, the main directions of peripheral orifices 682D and 682E also define an obtuse angle with each other on the side of the central orifice 682A.

Advantageously, force absorber 68 is made from a material that is elastically deformable in the temperature range at which helmet 2 is used. For example, the material may be thermoplastic, in particular a thermoplastic elastomer (TPE).

The geometry and material of force absorber 68 enable it to be manufactured economically, with good reproducibility of its mechanical properties.

In helmet 2, force absorber 68 is positioned between cushion 66 and the bottom of inner surface 44 of outer shell 4.

The first two straps 64A and 64B each pass through some of orifices 682, while the third strap 64C extends between cushion 66 and force absorber 68 without passing through orifices 662 or through orifices 682.

The first strap 64A arrives on upper face S68 of force absorber 68, close to its longitudinal edge 684A, passes through peripheral orifice 682C from upper face S68 to lower face S'68. It then extends along lower face S'68 to central orifice 682A, which it passes through from lower face S'68 to upper face S68. Strap 64A is folded around first longitudinal edge 682F of central orifice 682A, resting on faces S68 and S'68, which are parallel and separated by a distance equal to the thickness e68 of force absorber 68. From central orifice 682A, strap 64A extends along upper face S68 to peripheral orifice 682B, which it passes through from upper face S68 to lower face S'68. From orifice 682B, first strap 64A joins longitudinal edge 684A, resting on lower face S'68. In this way, first strap 64A is folded 180° around first longitudinal edge 682F of central orifice 682A, running between orifices 682C and 682B, respectively along upper face S68 between longitudinal edge 684A and peripheral orifice 682C, along lower face S'68 between peripheral orifice 682C and the central orifice 682A, along upper face S68 between central orifice 682A and peripheral orifice 682B, and along lower face S'68 between peripheral orifice 682B and longitudinal edge 684A.

Alternatively, it may be provided that first strap 64A arrives on upper face S68 of force absorber 68, close to its longitudinal edge 684A, passes through peripheral orifice 682B from upper face S68 to lower face S'68. It then extends along lower face S'68 to central orifice 682A, which it passes through from lower face S'68 to upper face S68. Strap 64A is folded around first longitudinal edge 682F of central orifice 682A, resting on faces S68 and S'68 which are parallel and separated by a distance equal to thickness e68 of force absorber 68. From central orifice 682A, strap 64A extends along upper face S68 to peripheral orifice 682C, which it passes through from upper face S68 to lower face S'68. From orifice 682C, first strap 64A joins longitudinal edge 684A, resting on lower face S'68. In this way, first strap 64A is folded 180° around first longitudinal edge 682F of central orifice 682A, running between orifices 682B and 682C, respectively along upper face S68 between longitudinal edge 684A and peripheral orifice 682B, along lower face S'68 between peripheral orifice 682B and central orifice 682A, along upper face S68 between central orifice 682A and peripheral orifice 682C, and along lower face S'68 between peripheral orifice 682C and longitudinal edge 684A.

In practice, thickness e68 is between 1.0 mm and 6.0 mm, preferably equal to 2.6 mm.

The second strap 64B arrives on upper face S68 of force absorber 68, close to its longitudinal edge 684B, passes through peripheral orifice 682E from upper face S68 to lower face S'68. It then extends along lower face S'68 to central orifice 682A, which it passes through from lower face S'68 to upper face S68. Strap 64B is folded around second longitudinal edge 682G of central orifice 682A, resting on faces S68 and S'68. From central orifice 682A, strap 64B extends along upper face S68 to peripheral orifice 682D, which it passes through from upper face S68 to lower face S'68. From orifice 682D, second strap 64B joins longitudinal edge 684B, resting on lower face S'68. In this way, second strap 64B is folded 180° around second longitudinal edge 682G of central orifice 682A, running between orifices 682E and 682D, respectively along upper face S68 between longitudinal edge 684B and peripheral orifice 682E, along lower face S'68 between peripheral orifice 682E and central orifice 682A, along upper face S68 between central orifice 682A and peripheral orifice 682D, and along lower face S'68 between peripheral orifice 682D and longitudinal edge 684B.

Alternatively, it may be provided that first strap 64B arrives on upper face S68 of force absorber 68, close to its longitudinal edge 684B, passes through peripheral orifice 682D from upper face S68 to lower face S'68. It then extends along lower face S'68 to central orifice 682A, which it passes through from lower face S'68 to upper face S68. Strap 64B is folded around second longitudinal edge 682G of central orifice 682A, resting on faces S68 and S'68. From central orifice 682A, strap 64B extends along upper face S68 to peripheral orifice 682E, which it passes through from upper face S68 to lower face S'68. From orifice 682E, second strap 64B joins longitudinal edge 684B, resting on lower face S'68. In this way, second strap 64B is folded 180° around second longitudinal edge 682G of central orifice 682A, running between orifices 682D and 682E, respectively along upper face S68 between longitudinal edge 684B and peripheral orifice 682D, along lower face S'68 between peripheral orifice 682D and central orifice 682A, along upper face S68 between central orifice 682A and peripheral orifice 682E, and along lower face S'68 between peripheral orifice 682E and longitudinal edge 684B.

Each of first and second straps 64A and 64B is anchored to force absorber 68 by passing successively through the three orifices through which it passes. In particular, when one of these two straps 64A and 64B is tensioned, the strap tends to press on edge 682F or 682G of central orifice 682A, which has the effect of elastically deforming force absorber 68. In addition, the fact that each of straps 64A and 64B is folded 180° around one of edges 682F or 682G generates friction, between straps 64A and 64B and faces S68 and S'68, which impedes the potential sliding of this strap in central orifice 682A.

In the event of a downward impact on outer shell 4, the corresponding force is transmitted to heels 644 and 646, and therefore to holding device 6. This force is transmitted to perimeter 62 and first two straps 64A and 64B by hooking members 64D, and to third strap 64C by mounting members 64E.

As cushion 66 rests on the top of the user's skull, the force transmitted to straps 64A, 64B and 64C has the effect of tensioning them, between their ends rigidly connected to hooking members 64D and mounting members 64E, respectively.

Tensioning straps 64A and 64B, which are locked on force absorber 68, has the effect of elastically deforming force absorber 68, which thus absorbs part of this force, that part being not transmitted, via cushion 66, to the top of the user's skull. Thus, the use of force absorber 68 and the positioning of first and second straps 64A and 64B on this absorber makes it possible to dissipate part of the force resulting from an impact on outer shell 4, which improves the comfort and safety of a user of helmet 2.

Tensioning strap 64C presses cushion 66 against the top of the user's skull.

In the example shown in the figures, the number of orifices 682 is equal to five, i.e., twice the number of straps 64A and 64B plus one.

A64 is a longitudinal axis of the portion of second strap 64B which extends between first peripheral orifice 682E and central orifice 682A, along lower face S'68. β is the smallest of the angles defined between axis A64 and main direction D682A. Advantageously, the angle β is greater than or equal to 30°, preferably greater than or equal to 40°. γ is the smallest of the angles defined between axis A64 and main direction D682E. Advantageously, the angle γ is greater than or equal to 40°, preferably greater than or equal to 60°.

Similar angles may be defined between straps 64A and 64B and the other orifices.

The values of the angles α, β and γ allow an optimized spatial distribution of straps 64A and 64B within internal volume V4 of outer shell 4, in particular, without risk of these straps crossing each other or twisting.

In a variant not shown, the number of straps passing through force absorber 68 is different from two, for example, greater than or equal to three. The number of orifices in force absorber 68 is then adapted, preferably being equal to twice the number of straps passing through force absorber 68 plus one.

Straps 64A and 64B may pass through force absorber 68 along a different path to that shown in the figures, this path depending on the geometry of this absorber.

Any feature described above for one embodiment or variant is applicable to the other embodiments and variants described above, insofar as this is technically possible.

The invention claimed is:

1. A helmet comprising:

an outer shell; and a holding device for holding said outer shell on a user's head, the holding device comprising:

a perimeter forming a closed loop;

at least two straps attached to said perimeter and/or to said outer shell;

a cushion to support the user's head; and a force absorber comprising at least three orifices for the passage of at least one of said at least two straps, each orifice connecting a first face of the force absorber and a second face of the force absorber opposite the first face, wherein at least one of said at least two straps passes successively through a first of said at least three orifices, a second of said at least three orifices, and a third of said at least three orifices, extending on the first face between the first orifice and the second orifice and on the second face between the second orifice and the third orifice, and the at least one strap is folded 180° around an edge of the second orifice.

2. The helmet according to claim 1, wherein said force absorber is made of an elastically deformable material.

3. The helmet according to claim 2, wherein the elastically deformable material is a thermoplastic elastomer.

4. The helmet according to claim 1, wherein each of said at least three orifices is of elongate shape with its largest dimension greater than or equal to the width of each strap which passes through it.

5. The helmet according to claim 1, wherein said force absorber is in the form of a flat plate.

6. The helmet according to claim 1, wherein said force absorber comprises five orifices.

7. The helmet according to claim 1, wherein said force absorber comprises a central orifice and peripheral orifices.

8. The helmet according to claim 7, wherein said central orifice is the second orifice.

9. The helmet according to claim 7, wherein the main directions of two adjacent ones of said peripheral orifices through which the same strap passes form an obtuse angle on the side of the central orifice.

10. The helmet according to claim 1, wherein a longitudinal axis of one of said at least two straps and a main direction of the second orifice through which this strap passes form a first angle greater than or equal to 30°, and wherein the longitudinal axis of this strap and a main direction of the first orifice through which this strap passes form a second angle greater than or equal to 40°.

11. The helmet according to claim 10, wherein the first angle is greater than or equal to 40°.

12. The helmet according to claim 10, wherein the second angle is greater than or equal to 60°.

13. The helmet according to claim 1, wherein the number of orifices of said force absorber is equal to twice the number of straps which pass through said force absorber plus one.

14. The helmet according to claim 1, wherein two of said at least two straps are hooked to said perimeter and to said outer shell, and wherein another strap is hooked solely to said outer shell.

15. The helmet according to claim 14, wherein the straps hooked to said perimeter pass through said force absorber, and the strap hooked solely to said outer shell runs between said cushion and said force absorber.

* * * * *